United States Patent [19]

Palazzolo

[11] 4,089,525

[45] May 16, 1978

[54] PRO-SKILL BASKETBALL GAME

[76] Inventor: Michele Palazzolo, 19251 Stephens Dr., East Detroit, Mich. 48021

[21] Appl. No.: 597,001

[22] Filed: Nov. 13, 1975

[51] Int. Cl.[2] ..... A63B 65/12; A63F 7/06

[52] U.S. Cl. ..... 273/101; 273/1 ES; 273/DIG. 26; 124/4

[58] Field of Search ..... 273/85 R, 85 C, 85 E, 273/85 F, 95 R, 101, 102.2 R, 101.2 R, 96 R; 124/4

[56] References Cited

U.S. PATENT DOCUMENTS

| | | | |
|---|---|---|---|
| 846,286 | 3/1907 | Darlington | 273/101 |
| 1,382,696 | 6/1921 | Van Vleet | 124/4 |
| 1,563,983 | 12/1925 | Higuchi | 124/6 |
| 2,147,705 | 2/1939 | Hunter | 273/101 |
| 2,433,224 | 12/1947 | Koci | 273/85 F |
| 2,720,397 | 10/1955 | Blanton | 273/85 E |
| 2,783,754 | 3/1957 | Heiss | 273/85 F |
| 2,827,034 | 12/1953 | Rothe | 273/101 |
| 2,893,734 | 7/1959 | Tarte | 273/102.2 R |
| 3,074,720 | 1/1963 | Carver | 273/85 E |
| 3,228,688 | 1/1966 | Dennison | 273/85 R |
| 3,647,213 | 3/1972 | Baker | 273/101 |
| 3,834,701 | 9/1974 | Hashimoto | 273/85 C |

FOREIGN PATENT DOCUMENTS

| | | | |
|---|---|---|---|
| 1,349,550 | 12/1963 | France | 273/101 |
| 328,317 | 3/1920 | Germany | 273/96 |
| 634,993 | 2/1962 | Italy | 124/4 R |

*Primary Examiner*—William H. Grieb
*Assistant Examiner*—Lawrence E. Anderson
*Attorney, Agent, or Firm*—Harness, Dickey & Pierce

[57] ABSTRACT

A basketball game requiring operator skill in operating a ball thrower arm lever which throws a ball that has been positioned at the end of the lever by means of a funnel assembly. The ball is thrown toward a basket. A scoring mechanism is provided whereby the number of baskets are scored and, if a predetermined number is scored within the preset time interval, a free game is provided. Means are provided for returning the ball to the ball thrower lever and an arrangement is additionally incorporated for permitting release of the ball in the event it is trapped under the ball thrower lever arm at the base of the funnel. The game includes an illuminated scoreboard and a mechanism for ringing a bell after each basket is made. A ball lock is also incorporated for preventing return of the ball to the ball thrower arm lever after the completion of the last basket at the preset time interval, unless the free game has been provided.

11 Claims, 6 Drawing Figures

PRO-SKILL BASKETBALL GAME

BACKGROUND OF THE INVENTION

This invention relates to an improved game construction and more particularly to an improved basketball skill game.

Various game constructions have been proposed which simulate actual athletic games. For one example of such games are coin operated games which simulate basketball games. All of the games heretofore proposed have, however, failed to accurately simulate the skills involved in playing basketball.

It is, therefore, a principal object of this invention to provide an improved basketball game which more accurately simulates the actual game.

It is another object of the invention to provide an improved basketball game incorporating a ball throwing mechanism whereby the operator's actions necessary to throw the ball more accurately reflect those encountered in the actual game.

A further object of the invention is to provide an improved mechanism for returning the ball to the operator-controlled throwing mechanism.

A still further object of the invention is to provide a construction for permitting release of the ball in the event it becomes jammed.

SUMMARY OF THE INVENTION

A game embodying this invention comprises a cabinet having a game floor therein. A throwing lever is suppoted for pivotal movement about a horizontal axis beneath the game floor. The throwing lever has means defining a pocket at one end thereof adapted to receive a ball. A manual operated lever is pivotally supported within the cabinet and has an operating handle at one end thereof exposed outwardly of the cabinet for pivotally moving of the operating lever by a player positioned adjacent the cabinet. Motion transmitting means are effective to pivot the throwing lever on pivotal movement of the manually operated lever for permitting a player to throw a ball from the throwing lever pocket upwardly from the floor upon pivotal movement of the manually operated lever.

DETAILED DESCRIPTION OF THE PREFERRED EMBODIMENTS

Listing of the Parts

Figures 1, 2:
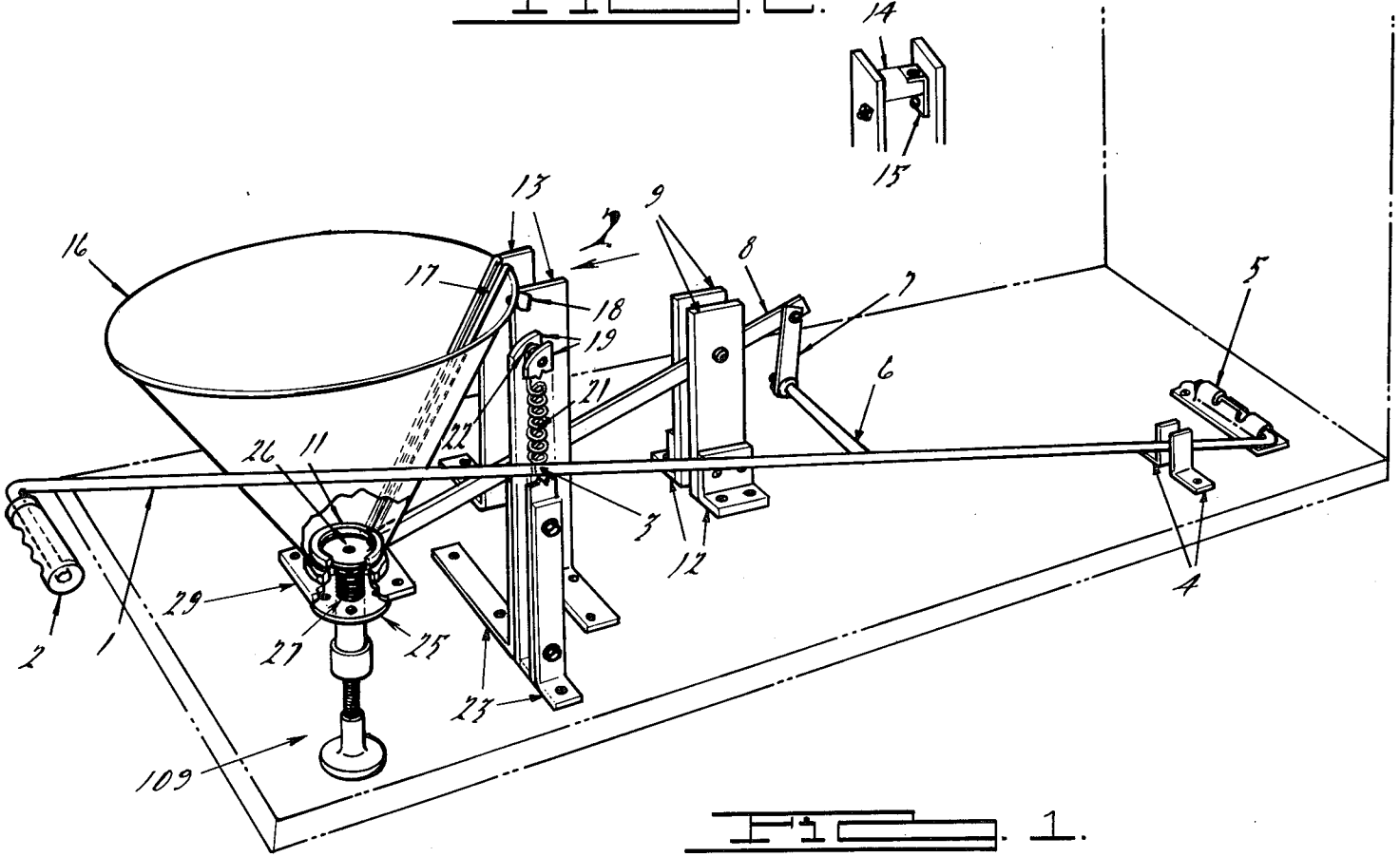
FIG. 1 is a perspective view of a portion of a basketball game embodying this invention and shows the mechanism for centering the ball and for throwing of it.
FIG. 2 is an enlarged perspective view taken in the direction of the arrow 2 in FIG. 1.
Figure 4:
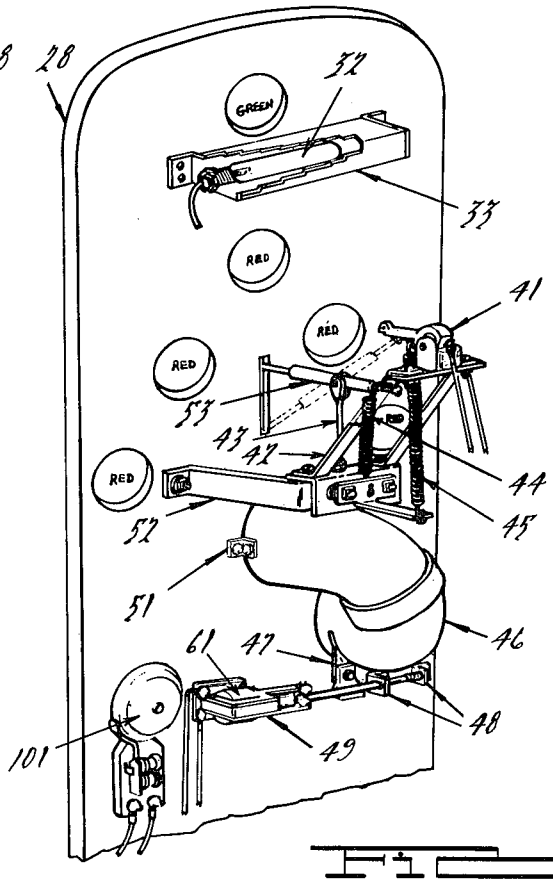
FIG. 4 is a perspective view, in part similar to FIG. 3, showing the rear of the board and the structure attendant thereto.

Parts Appearing Primarily in FIG. 1

Parts #1 — "Hand Manual Lever"

Solid iron rod (⅜ inch O.D. × 38 inch length). Extends through a slot outside of the game cabinet (6½ inches) with a (4 inch) bend 90° rightside angle for the handle. Total outside length (6½ inches). The remainder of iron rod (31½ inches) extends inside the game connecting in conjunction with other mechanical moving parts.

Parts #2 — "Hand Manual Lever Rubber Handle Assy."

(3⅜ inch length 1 inch O.D.) Bicycle type rubber handle for hand comfort.

Parts #3 — "Hand Manual Lever Eyebolt Spring Support Assy."

(¾ inch length × ¼ inch O.D. eyebolt) Inserted in the Hand Manual Lever and connected to the Retractor Spring for flexible operation downward and upward.

Parts #4 — "Hand Manual Lever Rear Guide Brackets Assy."

(1⅛ inch height × 1 inch length × ½ inch width) Two metal angle brackets to guide and stabilize Hand Manual Lever.

Parts #5 — "Hand Manual Lever Rear Hinge Stabilizer Assy."

(4½ inch length × 1⅜ inch width) A metal door lock hinge to stabilize the bottom portion of the Hand Manual Lever Rod. A (3 inch) Bend, 90° leftside angle is inserted through the rear hinge for flexible operation.

"Hand Manual Lever Connector Assy."

Two functional iron hinges - first hinge 6 is a round solid iron rod (4½ inch length ⅜ inch O.D.) welded to the Hand Manual Lever. The opposite end of this rod is threaded which connects to the bottom of second hinge 7 which is (flat metal 2 inch length × ⅝ inch width) with a washer and nut. The upper portion of the second hinge is connected with a bolt and nut to the Ball Throw Arm Lever 8, which is in turn connected to the Ball Throw Arm Lever Hinge Post 9 with a bolt and nut for flexibility.

Parts #8 — "Ball Throw Arm Lever"

Square aluminum metal (10¾ inch length × ½ inch width × ¼ inch thick). Permanently connected at the lower portion of the Ball Throw Arm Lever Setting Ring 11. Which centers and holds the ball in position.

Parts #9 — "Ball Throw Arm Lever Hinge Posts Assy."

Two flat hinges made of aluminum (5 inch length × ½ inch width × 3/16 inch thick) connected to the Ball Throw Arm Lever on both sides, used for flexible rocker motion with perfect balance and alignment. Guiding Ball Throw Arm Lever to strike directly at the rubber bumper (FIG. 2).

Parts 12 — "Ball Throw Arm Lever Hinge Post Guide Brackets Assy."

Two angle brackets made of aluminum (1½ inches × 1 inch × ⅛ inch thick) to support and reinforce Ball Throw Arm Lever Hinge Post 9.

Parts #13 — "Ball Throw Arm Lever Bumper Brackets Support"

Two angle iron metal brackets (6½ inch × 2½ inch × 1 inch width ⅛ inch thick) right and left side to support and stabilize rubber bumper 14 (FIG. 2).

Parts #14 — "Ball Throw Arm Lever Rubber Bumper Assy."

Solid rubber (2 inch length × ¾ inch width × ½ inch thick). To release ball from the Ball Throw Arm Lever Setting Ring.

Parts #15 — "Ball Throw Arm Lever Bumper Brackets Assy."

Two angle brackets (only one of which appears in the drawings) (1 inch × ½ inch × ½ inch thick) flat metal right and left side to support and stabilize rubber bumper.

Parts #16 — "Ball Setting Funnel Guide"

Made of tin (9 inch diameter × 6½ inch height). Used to receive the ball which rolls by gravitation, setting it down to the center of the Ball Throw Arm Lever Setting Ring 11.

Parts #17 — "Ball Setting Funnel Guide Slot Assy."

An open slot (7 inch height × ⅜ inch width) through the funnel, seamed with reinforced metal (⅛ inch width × 1/16 inch thick × 7 inch height) on both sides, to allow the inserted portion of the Ball Throw Arm Lever Setting Ring 11 to move upward and downward.

Parts #18 — "Ball Setting Funnel Guide Brackets Support Assy."

Two metal angle brackets (only one of which appears in the drawings) (½ inch × ½ inch × ½ inch width) right and left side to stabilize Ball Setting Funnel Guide 16.

Parts #19 — "Hand Manual Lever Hinge Guide Supports"

Two metal hinges (7 inch length × ⅞ inch width × ⅛ inch thick) guiding Hand Manual Lever down and up by a connecting retractor spring 21.

Parts #21 — "Hand Manual Lever Hinge Guide Retractor Spring Assy."

(2 inch length × ¼ inch O.D.) Connected to the Hand Manual Lever Eyebolt 3 to retract and support the Hand Manual Lever 1 back to its normal upward position.

Parts #22 — "Hand Manual Lever Hinge Guide Spacer Support Assy."

(⅜ inch O.D. tube bushing made of metal with 1 inch × ⅛ inch) bolt inserted through the hinge guides 19 to stabilize Hand Manual Spring Retractor and Guide Supports.

Parts #23 — "Hand Manual Lever Hinge Guide Brackets Support Assy."

Two brackets No. (1.) (3½ inch × 3½ inch × ¾ inch width) left side. No. (2.(3½ inch × 1¼ inch × ¾ inch width) right side. To reinforce Hand Manual Lever Hinge Guide Supports 19.

Parts #24 — "Ball Setting Funnel Guide Base Support Assy."

A metal base plate (3½ inches × 3 inches) welded to a threaded pipe fitting cap 25 (2½ inch O.D. × 2½ inch I.D. × ¾ inch deep). Used to stabilize and support Ball Setting Funnel Guide 16.

Parts #26 — "Ball Safety Release Ejector Assy."

Two pipe fittings (2 inch length × ¾ inch O.D.) One pipe flange (¾ inch × 2½ inch diameter) One solid iron rod (6 inch length × ⅜ inch O.D.) One metal cap handle (2 inch diameter) One inside spring 27 (½ inch O.D. × 2 inches). This assembly is used to eject the ball when it becomes trapped in the funnel under the Ball Throw Arm Lever Setting Ring.

Parts #11 — "Ball Throw Arm Lever Setting Ring"

Made from a round aluminum pipe (2½ inch O.D. × 2⅛ inch I.D. × ⅜ inch thick) Permanently connected to the Ball Throw Arm Lever 8, intercepting ball after it rolls into the Ball Setting Funnel Guide 16. It centers and holds the ball in position.

PARTS APPEARING PRIMARILY IN FIG. 3

Parts #28 — "Front and Rear Assembly Board"

(28¼ inch height × 12 inches width) Made of ¼ inch plexiglass. Front side used for score board function assembly. Rear side used for mechanical and electrical assy.

Parts #29 — "One Green Free Game Light"

(1¾ inch diameter × 1 inch length) Glass and chrome light fixture.

Parts #31 — "Free Game Front Score Board Sign"

Figure 3:
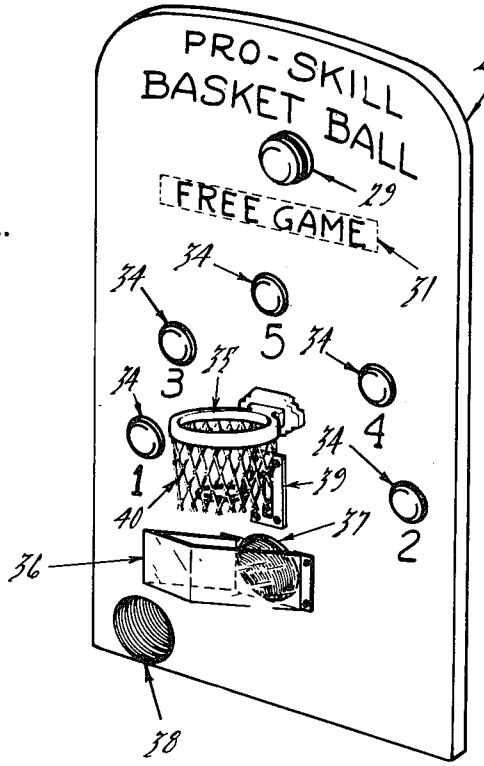
FIG. 3 is a perspective view showing the front of the scoreboard and basket holding portion of the game.
Figure 5:
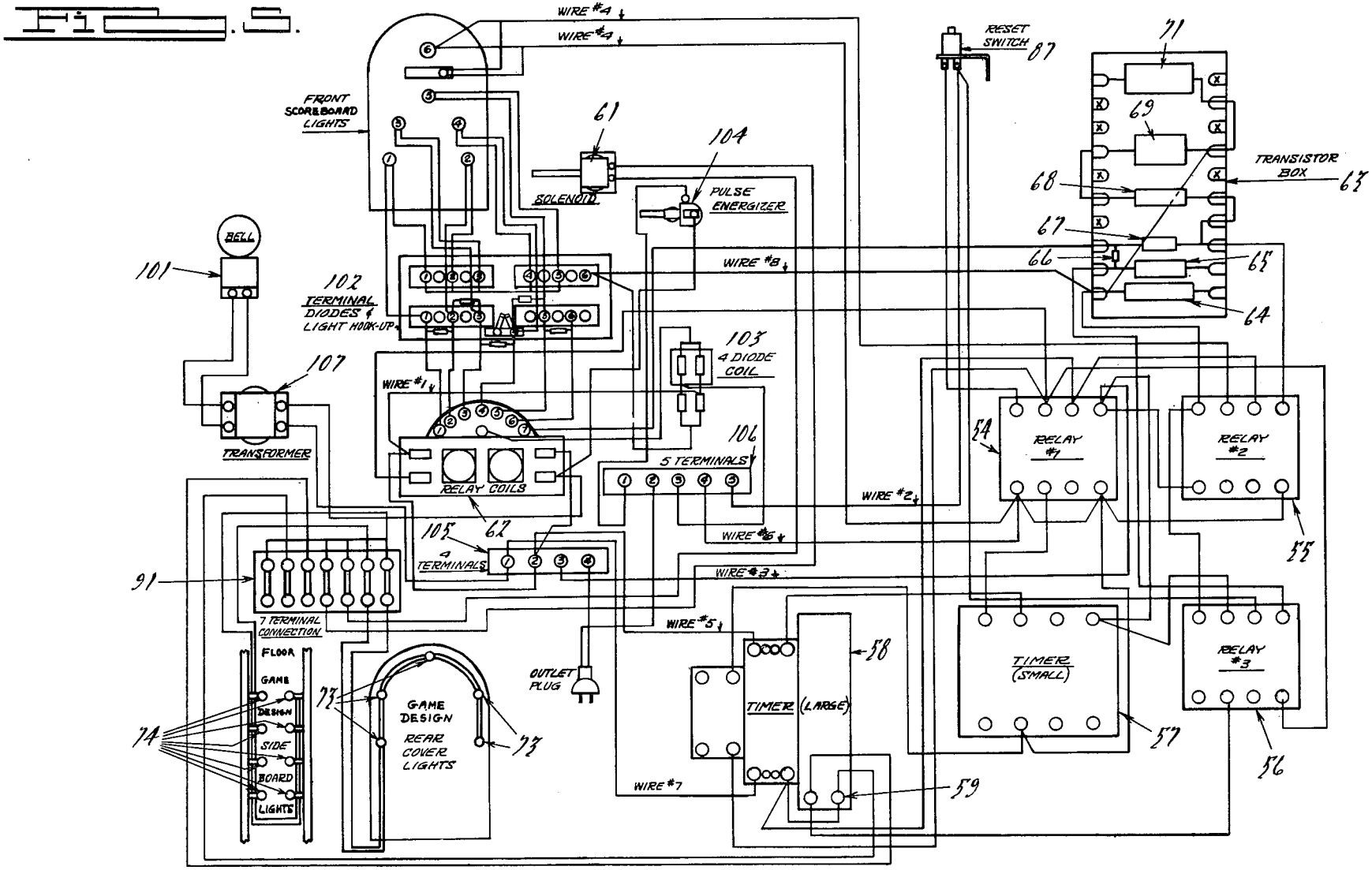
FIG. 5 is a schematic electrical diagram of the game.
Figure 6:
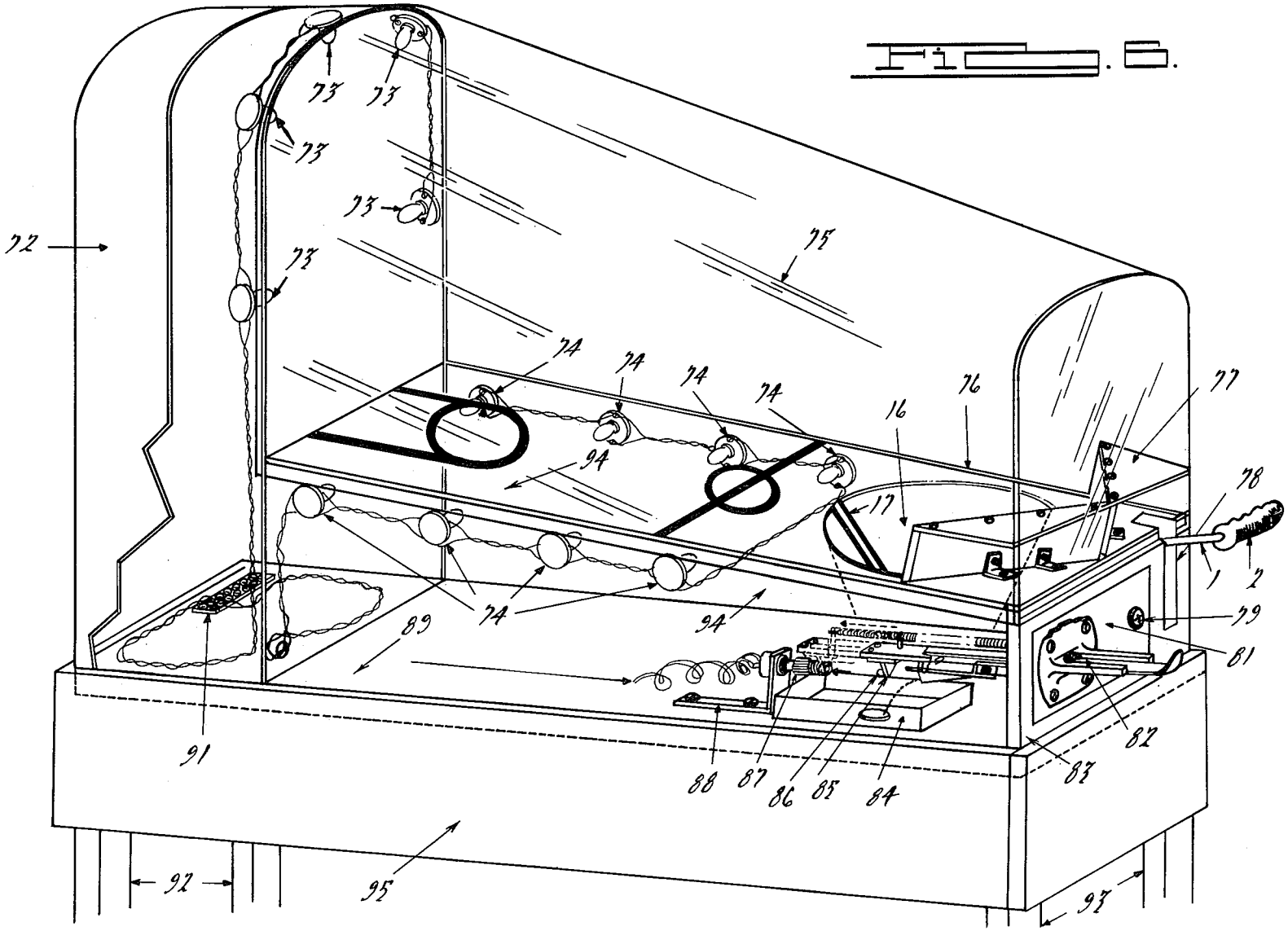
FIG. 6 is a perspective view, with portions broken away, of the game.

(5 inch length × ⅝ inch width) The sign is aluminated by a 6 watt bulb 32 concealed in plexiglass box 33 in assy. located on the back of the score board (FIG. 3).

Parts #34 — "(5) Red Score Board Game Lights"

(1⅛ inch diameter × ¾ inch length) Glass and chrome light fixtures.

Parts #35 — "Basketball Ring"

(3½ inch O.D. × 2¾ inch I.D.) Made of chrome metal. Stabilized by one chrome bracket (2½ inches × 1¾ inches).

Parts #36 — "Ball Drop Chute"

(5½ inch length × 2¾ inch width × 2 inch depth) box shaped. Made of (⅛ inch) plexiglass. Attached to "Ball Channel Tube" entrance 37 for ball return.

Parts #38 — "Ball Return Channel Tube Slots"

Ball entrance (2½ inch I.D.) Ball outlet (2½ inch I.D.)

Parts #39 — "Ring Lever Slot Front Plate"

(2¾ inch length × 1⅜ inch width) Made of chrome metal.

Parts #40 — "Basketball Net"

(3½ inch O.D. × 2½ inch length) made of chalk line string. Attached to basketball ring 35.

PARTS APPEARING PRIMARILY ON FIG. 4

Parts #33 — "Free Game (Rear) Light Assy."

(6¼ inch length × 1 inch height × 1⅝ inch width) Made of (⅛ inch) plexiglass (coated black). With one 6 watt bulb 32 enclosed.

Parts #41 — "Pulse Contact (Rear) Energizer Assy."

(2¼ inch length × 1¾ inch height) Made of copper and bakelite connected to hand made brackets 42 (3 inches × ¾ inch × ⅛ inch) used for energizing score board lights.

Parts #43 — "Rear Contact Ring Lever Assy."

(⅛ inch O.D.) Metal rod connected to (⅛ inch O.D.) metal rod hinge. This assembly is connected to a bracket (3 inch length × 1 inch width) used to strike at pulse energizer 41 after each basket is made and lights up score board.

Parts #44 — "Ring Lever Stabilizer Spring Assy."

(2¾ inch length × ¼ inch O.D.) Used to retract ring lever back in position.

Parts #45 — "Pulse Energizer Stabilizer Spring Assy."

(4½ inch × ¼ inch O.D.) Used to retract pulse energizer back in position.

Parts #46 — "Ball Recycling Channel Tube Assy."

Two pipe elbows (3 inch O.D.) connected together, made of solid copper. Used to recycle the ball back to the ball setting funnel guide 16. It also works in conjunction with the Solenoid ball gate lock 47 before and after the game.

Parts #48 — "Solenoid Guide Brackets Assy."

Two angle brackets (slotted) (1 inch × ¾ inch × ¾ inch width) Made of aluminum. Guiding solenoid assy operation to function ball gate lock 47.

Parts #49 — "Solenoid Bracket and Spring Assy."

One flat bracket (2½ inches long × ¼ inch width) connected to the Solenoid metal bolt and inserted through the Solenoid Guide Brackets 48 to function ball gate lock, to open and close.

Parts #47 — "Solenoid Ball Gate Lock"

(1½ inch height × ½ inch width) connected to the Solenoid Assy Bracket, operating horizontally in and out of the Ball Recycling Channel Tube 46, to release and lock the ball before and after the game.

Parts #51 — "Channel Tube (4 only one of which appears in the drawings) Brackets"

(½ inch × ½ inch) To stabilize channel tube assy.

Parts #52 — "Pulse Energizer Bracket Assy."

Two aluminum brackets (4½ inches × ¾ inch) and two metal brackets (5½ inches × ¾ inch) both connected to stabilize pulse energizer assembly 41.

Parts #53 — "Ball Contact Ring Lever"

(⅛ inch O.D. × 7½ inch length) A metal rod centered inside of basket. When ball drops in the basket, it strikes down on the ring lever and energizes score board lights.

PARTS APPEARING PRIMARILY IN FIG. 5

All electrical devices and electronic components are pre-made.

54. Relay #1 — "Potter & Brumfield" — Model-6 13 OY7, KRP-11A, 50–60 HZ.

55. Relay #2 — "Potter & Brumfield" — Model-G 204 D1, KCP-11, 10,000 OHMS.

56. Relay #3 — Same as #2 Relay 55. To energize automatic game functions.

57. Small Timer — To delay (Free Game Sign) 2½ seconds and automatically triggers reset button to start a free game.
"Automatic Timing & Controls, Inc."
319 Time Delay Relay Q.C. 10
3281 = 120 volts HZ 50–60 Type 319A00601X

58. Large Timer — (adjustable) Set for 3 minutes playing time. Can be adjusted for more or less time.
Catalog No. Series 700 NT C — A.C. 300 volts max. — 10 amps non-deductive. Heavy Pilot Duty D.C. 250 volts max. Standard Pilot Duty.

59. Bottom Section of Large Timer-Electrical Connection for game pattern design lights.
Catalog No. 700-N200 A1 — Series B
120 V — 60 HZ — 110 V — 50 HZ — 84AB86 Coil

61. Solenoid — "Guardian" Mod. To open and close ball gate lock before and after each game.
12-INT-120A (Ball Gate Lock Assembly)

62. Stepper Relay — "Guardian" (Scoreboard Energizer) To light up score board lights individually after each basket is made
L.H. — 120 V — 60 HZ — 450 OHMS
R.H. — 120 V — 60 HZ — 110 OHMS

63. Transistors (Electronic Assembly Box) For complete electronic operation injunction with large timer for power output.

64. Spraque + Atom + TVA 1508 — 20 UF + 250 VDC + −85° C 185° F, USA 71308

65. Brown — Silver — Black

66. IN207 — IT

67. IN207 — IT
Brown — Silver — Black

69. + Sprague — Atom R, Lyric-TVA-1508
250 VDC — 300 VDC — Surge
85° - 185° F - +6704

71. + Sprague — Atom R + TVA 1512 — +5OUF
250 VDC — 85° C 7152 L

PARTS APPEARING PRIMARILY IN FIG. 6

Parts #72 — "Game Cabinet Rear Cover"

(28 inches high × 12 inch width) Has arc shaped top. Made from ¼ plywood. Used to cover all rear electrical parts operation.

Parts #73 — "(5) Rear Cover Lights"

(6 watts each) To reflect front score board pattern designs. Connected in series with 8 floor pattern design lights 74.

Parts #74 — "(4) Floor Pattern Design Lights"

(6 watts each) — to reflect basket ball floor pattern designs.

Parts #75 — "Arc Shaped Plexiglass Dome"

(28 inch length × 20 inch rear height × 14 inch front height × 13½ inch width × ⅛ inch thick) The over-all dimensions (53½ inch × 28 inch) flat sheet — made into arc shaped dome. Used to enclose top portion of basketball game for complete viewing and sealed enclosure.

Parts #16 — "Funnel Setting Ball Return"

As previously described in connection with FIG. 1, (9 inch diameter × 6½ inch height) made from tin metal. Used to roll tennis ball by gravitation down to center itself directly on the "Ball Throw Arm Lever and Ring Setter" for perfect alignment.

Parts #76 — Right Sideboard Chassis"

(9⅜ inch rear height) tapering down to (6 inch front height × 27¼ inch length) Made of ⅜ inch plywodd. Used to box in all electronic and mechanical parts of the game.

Parts #77 — "Front Corners Ball Bumper Guards"

(2⅜ inch height × 7 inch length) Made of ¼ inch plexiglass. Used to bounce ball back into "Ball Setting Funnel Guide 16" for safety.

Parts #78 — "Outside Front Manual Lever Slot"

(4 inch height × ⅝ inch width × ½ inch depth) cut-out. Used to free "Hand Manual Lever 1" to move down and back up during game operation.

Parts #2 — "Manual Lever Rubber Handle"

As previously described in connection with FIG. 1, (3⅜ inch length × 1 inch O.D.) A bicycle type rubber handle for comfort.

Parts #79 — "Coin Slot Door Keylock"

(1 inch O.D. metal keylock) Inserted in coin slot door 81, made of ½ inch plywood.

Parts #82 — "Manual Coin Slot"

Pre-made, prior art type, five-cent mechanical metal coin slot. Inserted in a hand made slot door 81 (7¾ inch × 4 inch) ½ inch plywood which is also inserted in a hand made front panel cut-out (11½ inches × 6 inches) also made of ½ inch plywood 83.

Parts #84 — "Inside Coin Deposit Box"

(5¾ inch × 2⅞ inch × 1¼ inch) Pre-made plastic box.

Parts #85 — "Coin Slot (Inside) Contact Bumper"

(1⅜ inch × ½ inch) Hand made bracket with bolts and nuts. Iron shim (1½ inch × ¾ inch) and one (½ inch × ½ inch O.D.) pre-made rubber cap 86 connected to the inside end of coin slot which triggers reset button 87 and starts the game in operation.

Parts #87 — "Game Starter Assy Energizer Reset Button"

Pre-made electrical switch. Attached to (4 inch × 2¾ inch × ⅛ inch) flat iron bracket 88 to stabilize reset button directly face to face with coin slot rubber bumper 86.

Parts #89 — "Game Floor Board Inset"

(1 inch depth × 12 inch width × 36 inch length) Panel base layout for mechanical fixtures and electrical devices.

Parts #91 — "Electric Connection Terminal"

(4¼ inch × 1 inch) (7) Double terminals. Connection for electrical game operation and lights for game pattern designs.

Wire connection shows (13) 6 watt lights connected in series for game pattern design alumination.

Parts #92 — "Levelers Attached (2) Rear Chassis Legs"

Pre-made levelers. To level and balance game for perfect alignment.

Parts #93 — "Levelers Attached (2) Front Chassis Legs"

Pre-made levelers. To level and balance game for perfect alignment.

Parts #94 — "Front and Center Basketball Floor Design Pattern"

Top floor cover (11½ inch × 27½ inch × ¼ inch thick) Basketball floor pattern design.

Parts #94 — "Left Side Sideboard Chassis"

(9⅜ inch rear end height) Tapering down to (6 inch front end height — 27¼ inch length) made from ⅜ inch plywood. To box in all electrical and mechanical parts.

Parts #95 — "Basketball Game Chassis"

Upper game portion sets on lower portion game chassis 95. Made of wood upper game portion dimensions (2⅛ inch) height from the back tapering down to 18½ inch) height from the front (12 inch width). Lower game portion 95 (32 inch height × 14½ inch width × 6 inch) upper panel board with (4) legs (2 inch × 2 inch × 26 inch height) with (4) levelers 92 and 93 attached at the bottom of each leg.

DETAILED DESCRIPTION OF THE PREFERRED EMBODIMENT

My "PRO-SKILL BASKETBALL GAME," comes in two parts (upper and lower). The upper portion is the game operation. The dimensions are: 36 inches long; 12 inches wide; 28 inches high from the back tapering down to 20½ inches high at the front. This upper portion is enclosed with an arc-shaped Plexiglass Dome 75, which is 28 inches long; 12 inches wide; 18 inches high from the back tapering down to 14½ inches high at the front of the game.

The lower portion is the game's Table Chassis. The dimensions are: 37 inches long; 14½ inches wide; 6 inch depth. Total height from front to back (32 inches) including four legs 92, 93. Each leg has a level adjuster, to balance the game for perfect alignment.

The overall (upper and lower) dimensions are from 60 inches high from the back to the floor tapering down to 50½ inches high from the front to the floor. 37 inches long × 14½ inches wide.

My "PRO-SKILL BASKETBALL GAME" can be built in several different sizes. The following are proposed dimensions:

First: Professional size for public amusements with coin and electrical operation. Dimensions approximately 6 feet high from the back tapering to 5 feet high at the front; 5 feet long; 2 feet wide. Total measurements would include the upper and lower portion of the game.

Second: For teen-agers and adults in private homes with electrical operation and with or without coin operation. Dimensions approximately 5 feet high from the back tapering to 4 feet at the front; 4 feet long; 1½ feet wide. Total measurements include the upper and lower portion of the game.

Third: For children in private homes with electrical operation only. Dimensions approximately 4 feet high from the back tapering to 3 feet high at the front; 3 feet long; 1 foot wide. Total measurements include the upper and lower portion of the game.

Fourth: Table model toy size for tiny tots in private homes without electrical or coin operation and without Table Chassis, made of all plastic. Dimensions approximately 2 feet high from the back tapering to 1½ feet high at the front; 2 feet long; 1 foot wide.

OPERATION

A coin is placed in the slot 82. Player then pushes slot handle 82 forward. On the inside at the opposite end of the Coin Slot Handle is a Rubber Bumper 85. When the slot handle is pushed in, the inside Rubber Bumper 85 strikes an Electrical Reset Button Assembly 87. The Reset Button 87 energizes the game for operation and automatically triggers:

1. All Electrical Pattern Designed game lights 73, 74.
2. Timer 58, which sets itself for three minutes of playing time.
3. Solenoid 61 to unlock Ball Gate Lock Slot 47 inside the Ball Return Channel Tube 46.

A tennis ball is then immediately released from inside the Ball Return Channel Tube 46 and rolls out by gravitation down into the Ball Funnel Setter 16 and centers itself on the Ball Thrower Arm 8 and Ring Setter Assembly 11. This starting process is completed in less than three seconds. Player can now start game in operation.

The Hand Manual Lever 1 is the key operation which starts other connecting parts to function. The Hand Manual Lever 1 is inserted through the Hand Manual Lever Hinge Guide Support 19, and then connected from the Hand Manual Lever Eyebolt 3, Spring Support Assembly 21, for flexible operation.

The Hand Manual Lever 1 operates mechanically with the use of one hand by striking a vertical downward hand stroke, and is then immediately released to return to its normal upward position, by the Hand Manual Lever Hinge Guide Retractor Spring Assembly 21, which is also connected to the upper portion of the Hand Manual Lever Hinge Guide Supports 19 and holds the Hand Manual Lever in its normal upward position. The Hand Manual Lever is connected to the Hand Manual Lever Connector Assembly 6 and 7 to operate the Ball Throw Arm Lever 8.

The Hand Manual Lever starts the game in operation with a downward hand stroke and simultaneously brings up the Ball Throw Arm Lever Setting Ring 11 which is permanently connected to the Ball Throw Arm Lever 8. The Ball Throw Arm Lever 8 then strikes the Ball Throw Arm Lever Rubber Bumper Assembly 14 which throws the ball from the Ball Throw Arm Lever Setting Ring 11, forwarding the ball toward the basket 35. When the ball drops in the Basketball Ring 35, it strikes down on the Ball Contact Ring Lever 53 which energizes scoreboard lights 34, and rings a bell 101. The ball then falls in the Ball Drop Chute 36 and proceeds into the Ball Recycling Channel Tube Assembly 46 and follows its normal procedures by gravitation and returns back into the Ball Setting Funnel Guide 16 which sets the ball back to the center, on top of the Ball Throw Arm Lever Setting Ring 11. Player can only score a basket by using skill touch control. If he strikes Hand Manual Lever 1 too hard, the ball will bounce out of control. If player strikes too gently, ball will fall short of the basket. Player can eventually correct his touch and will improve by making more baskets. The competition is to make the first five red lights 34 then one green light 29 to win a free game within three minutes time limit.

The game has six lights 34 and 29. Each light will automatically light up individually after each basket is made. The scoreboard has five red lights 34 and one green light 29. Numbers from one to five are all red lights. If player makes the green light 29 before his three minutes playing time has expired, then he will receive a Free Game.

When player scores his first basket, the tennis ball drops through the basket assembly 35 and immediately strikes the Ring Contact Lever 3, which activates transformer to ring bell 101 and simultaneously energizes Score Board Assembly Lights 34 to go on in succession after each basket. When green light 29 goes on, it automatically triggers an electric sign 31 saying "Free Game" and simultaneously triggers the Game Re-Set Button 87 for player.

My "PRO-SKILL BASKETBALL GAME" is operated by an Electrical Timer Assembly (FIG. 9), which is connected and wired to: Re-Set Switch 87; (3) Relays 54, 55, 56; Transistor Box 63; Terminal Diodes 102 and Diode Coils 103; Relay Coils 62; Pulse Energizer 104; (16) Terminal Connections 91, 105 and 106; Bell Transformer 107, for complete automatic electrical functions. The Timer 58 is normally set for three minutes playing time. The player must score all six lights before his time is up; if not, the game shuts off automatically.

When the Game Timer 58 shuts off, it immediately activates a Solenoid Assembly 61, which slides the Ball Gate Lock 47 in a horizontal position thru a slot, inside the Ball Return Channel Tube 46. The ball remains behind the Gate Lock, which shuts off any further playing.

There may be times after the game shuts off, the ball will remain available. The player may then practice for his last shot at the basket 35. After his basket is made, the ball will drop in the Ball Chute 36 and roll into the Ball Return Channel Tube 46 and will remain locked behind the Gate Lock 47. The ball can only be released when player inserts a coin.

If the player strikes the Hand Manual Lever 2 downward and intentionally holds it down without releasing the Hand Manual Lever 2 to its normal position, the Ball Thrower Arm 8 will remain in the upward position. The ball then will roll into the Funnel Setter 16 and become trapped under the Ball Thrower Arm 8. Player shall then be penalized and lose the balance of his time.

To correct this hazard, I have installed a Ball Ejector Assembly 109 directly underneath the chassis of the game, at the center of the Ball Funnel 16. Instructions: Hold Hand Manual Lever 2 all the way down with one hand and with the other hand push Ball Ejector 109 upward. Ball will then flip out of the Ball Funnel, then immediately release the Hand Manual Lever 2. The ball will then roll back into the Ball Funnel 16 and will center itself back on the Ball Thrower Arm 8 and Ring Setter Assembly 11. The ball must be on top of the Ball Thrower Arm and Ring Setter 11 to operate the game.

It is to be understood that the foregoing description is that of a preferred embodiment of the invention. Various changes and modifications may be made without departing from the spirit and scope of the invention as defined by the appended claims.

I claim:

1. A ball throwing game comprising a cabinet having a game floor therein, a back wall and a basket mounted thereon, a throwing lever supported intermediate its ends for pivotal movement about a horizontal axis beneath said game floor, said throwing lever having means defining a pocket at one end of a size and shape to receive and confine a ball prior to throwing thereof, a manually operated lever pivotally supported within said cabinet, said pivot axis of said manually operated lever being disposed adjacent said back wall, said manually operated lever having an integral, perpendicularly disposed operating handle at one end thereof exposed outwardly of said cabinet and sized to be grasped within the hand of a player for pivotally moving said manually operated lever by a player positioned adjacent said cabinet at the end opposite said back wall, and motion transmitting means including means providing a pivotal connection to the other end of said throwing lever for pivoting said throwing lever upon pivotal movement of said manually operated lever for permitting a player to throw a ball from said throwing lever pocket upwardly from said floor toward said basket upon pivotal movement of said manually operated lever.

2. A ball throwing game as set forth in claim 1 further including resilient bumper stop means carried by said cabinet and juxtaposed to be engaged by a portion of said throwing lever upon its pivotal movement in the throwing direction.

3. A ball throwing game as set forth in claim 1 wherein the game floor has an opening formed therein above the throwing lever pocket, said opening being substantially larger than the ball to be thrown, and means defining a funnel-shaped portion extending from said opening to said throwing lever pocket when said throwing lever is in its normal position for delivering a ball from said floor opening to said throwing lever pocket.

4. A ball throwing game comprising a cabinet having a game floor therein, a throwing lever supported intermediate its ends for pivotal movement about a horizontal axis beneath said game floor, said throwing lever having means defining a pocket at one end thereof adapted to receive a ball, a manually operated lever pivotally supported at one end thereof within said cabinet, said manually operated lever having an operating handle at the other end thereof exposed outwardly of said cabinet for pivotally moving said manually operated lever by a player positioned adjacent said cabinet, and motion transmitting means including an arm rigidly connected to said manually operated lever intermediate its ends and means pivotally connecting said arm to the other end of said throwing lever for pivoting said lever upon pivotal movement of said manually operated lever for permitting a player to throw a ball from said throwing lever pocket upwardly from said floor upon pivotal movement of said manually operated lever.

5. A ball throwing game as set forth in claim 4 further including spring means biasing said manually operated lever to a normal position and resiliently opposing pivotal movement thereof in its throwing direction.

6. A ball throwing game comprising a cabinet having a game floor therein, a throwing lever supported for pivotal movement about a horizontal axis beneath said game floor from a normal position to a throwing position, said throwing lever having means defining a pocket at one end thereof adapted to receive a ball, a manually operated lever pivotally supported within said cabinet, said manually operated lever having an operating handle at one end thereof exposed outwardly of said cabinet for pivotally moving said manually operated lever by a player positioned adjacent said cabinet, motion transmitting means for pivoting said throwing lever upon pivotal movement of said manually operated lever for permitting a player to throw a ball from said throwing lever pocket upwardly from said floor upon pivotal movement of said manually operated lever and a ball ejector positioned beneath said throwing lever pocket when said throwing lever is in its normal position for ejecting a ball trapped beneath said throwing lever pocket.

7. A ball throwing game comprising a cabinet having a game floor therein terminating in an upstanding wall, a basket supported upon said upstanding wall, a throwing lever supported for pivotal movement about a horizontal axis beneath said game floor, said throwing lever having means defining a pocket at one end thereof adapted to receive a ball, a manually operated lever pivotally supported within said cabinet, said manually operated lever having an operated handle at one end thereof exposed outwardly of said cabinet for pivotally moving said manually operated lever by a player positioned adjacent said cabinet, motion transmitting means for pivoting said throwing lever upon pivotal movement of said manually operated lever for permitting a player to throw a ball from said throwing lever pocket upwardly from said floor upon pivotal movement of said manually operated lever, said game floor having an opening formed therein above said throwing lever pocket, said opening being substantially larger than the ball to be thrown, means defining a funnel-shaped portion extending from said opening to said throwing lever pocket when said throwing lever is in its normal position for delivering a ball from said floor opening to said throwing lever pocket, and a ball ejector disposed at the base of said funnel and beneath said throwing lever pocket when said throwing lever is in its normal position for ejecting a ball from said funnel if entrapped beneath said throwing lever.

8. A basketball type ball throwing game comprising a cabinet having a game floor therein, a throwing lever supported for pivotal movement about a horizontal axis beneath said game floor, between a normal position and a throwing position, said throwing lever having means defining a pocket at one end thereof adapted to receive a ball, a manually operated lever pivotally supported within said cabinet, said manually operated lever having an operating handle at one end thereof exposed outwardly of said cabinet for pivotally moving said manually operated lever by a player positioned adjacent said cabinet, motion transmitting means for pivoting said throwing lever upon pivotal movement of said manually operated lever for permitting a player to throw a ball from said throwing lever pocket upwardly from said floor upon pivotal movement of said manually operated lever, said game floor having an opening formed therein above said throwing lever pocket, said opening being substantially larger than the ball to be thrown, means defining a funnel-shaped portion extending from said opening to said throwing lever pocket when said throwing lever is in its normal position for delivering a ball from said floor opening to said throwing lever pocket, and means defining a ball receiving channel supported by said upstanding wall and juxtaposed to the discharge of said basket for receiving a ball passing through said basket and returning said ball to floor, said floor being inclined from said wall to said opening for gravity return of a ball from said ball receiving channel to said throwing arm pocket.

9. A ball throwing game as set forth in claim 8 further including counter means for counting the number of balls passing through said ball receiving channel.

10. A ball throwing game as set forth in claim 9 further including a ball lock disposed in said ball channel for precluding the return of a ball through said game floor opening.

11. A ball throwing game as set forth in claim 10 further including timer means for operating the ball lock to its locking position after a predetermined time interval and means interrelating said counter means with said ball lock for permitting return movement of a ball when a predetermined score of baskets has been counted within the time interval set by said timer means.

* * * * *

UNITED STATES PATENT AND TRADEMARK OFFICE

CERTIFICATE OF CORRECTION

PATENT NO. : 4,089,525

DATED : May 16, 1978

INVENTOR(S) : Michele Palazzolo

It is certified that error appears in the above-identified patent and that said Letters Patent are hereby corrected as shown below:

Column 1, line 35, "manual" should be --manually--.

Column 3, line 51, after "two" add --(2)--,
after "One" add --(1)--,
line 52, after "One" add --(1)--,
line 53, after "One" add --(1)--,
line 54, after "One" add --(1)--,
line 57, after "Ring" insert --11--.

Column 4, line 8, "6" should be in parentheses,
line 34, "6" should be in parentheses,
line 54, after "Two" add --(2)--,
line 64, after "One" add --(1)--.

Column 5, line 49, after "Box" add --63--.

Column 6, line 3, "8" should be in parentheses,
line 22, "plywodd" should be --plywood--,
line 51, after "one" add --(1)--.

UNITED STATES PATENT AND TRADEMARK OFFICE

CERTIFICATE OF CORRECTION

PATENT NO. : 4,089,525

DATED : May 16, 1978

INVENTOR(S) : Michele Palazzolo

It is certified that error appears in the above-identified patent and that said Letters Patent are hereby corrected as shown below:

Column 9, line 10, "3" should be --53--.
line 16, after "player" add --to start a new game without having to wait--.

Column 10, line 49, after "said", second occurrence, add --throwing--.

Signed and Sealed this

*Nineteenth* Day of *December 1978*

[SEAL]

*Attest:*

RUTH C. MASON
*Attesting Officer*

DONALD W. BANNER
*Commissioner of Patents and Trademarks*